US011383476B2

(12) United States Patent
Wagner et al.

(10) Patent No.: US 11,383,476 B2
(45) Date of Patent: Jul. 12, 2022

(54) COMPACT MANUAL DUNNAGE CONVERSION APPARATUS

(71) Applicant: Ranpak Corp., Concord Township, OH (US)

(72) Inventors: Dennis J. Wagner, Painesville, OH (US); Robert C. Cheich, Independence, OH (US)

(73) Assignee: Ranpak Corp., Concord Township, OH (US)

( * ) Notice: Subject to any disclaimer, the term of this patent is extended or adjusted under 35 U.S.C. 154(b) by 137 days.

(21) Appl. No.: 16/633,491

(22) PCT Filed: Aug. 6, 2018

(86) PCT No.: PCT/US2018/045361
§ 371 (c)(1),
(2) Date: Jan. 23, 2020

(87) PCT Pub. No.: WO2019/032447
PCT Pub. Date: Feb. 14, 2019

(65) Prior Publication Data

US 2021/0129477 A1 May 6, 2021

Related U.S. Application Data

(60) Provisional application No. 62/541,826, filed on Aug. 7, 2017.

(51) Int. Cl.
*B65H 16/00* (2006.01)
*B31D 5/00* (2017.01)
*B65H 23/06* (2006.01)

(52) U.S. Cl.
CPC ..... *B31D 5/0065* (2013.01); *B65H 16/005* (2013.01); *B65H 23/06* (2013.01);
(Continued)

(58) Field of Classification Search
CPC ..... B31D 2205/00; B31D 2205/0005; B31D 2205/0023; B31D 2205/0047; B65H 2801/63
(Continued)

(56) References Cited

U.S. PATENT DOCUMENTS 3,082,870 A 3/1963 Vickery
6,375,116 B1 * 4/2002 Askins ..... B65H 75/185 242/599.2

(Continued)

FOREIGN PATENT DOCUMENTS

WO WO-2016007728 A1 * 1/2016 ..... H04N 21/8455

OTHER PUBLICATIONS

International Search Report and Written Opinion dated Jan. 25, 2019 for PCT/US2018/045361.

(Continued)

*Primary Examiner* — Chelsea E Stinson
(74) *Attorney, Agent, or Firm* — Renner, Otto, Boisselle & Sklar, LLP

(57) ABSTRACT

A manually-operated dunnage conversion apparatus includes a housing, a support mounted in the housing and configured to support a supply of sheet material for dispensing from the dunnage conversion apparatus, and one or both of (a) a guide member mounted in the housing downstream of the support and providing a resilient surface across which the sheet material may be drawn to restrict tearing of the sheet material as it is drawn from the dunnage conversion apparatus, and (b) a tensioning assembly mounted in the housing and configured to apply a compressive force between opposite axial sides of the housing to control the force necessary to dispense the supply of sheet material. Except for the tensioning assembly, the apparatus may be made of paper-based products, making the apparatus recy-
(Continued)

clable, reusable, and composed of a renewable resource, as well as inexpensive to manufacture.

8 Claims, 17 Drawing Sheets

(52) U.S. Cl.
CPC ..... *B31D 2205/007* (2013.01); *B31D 2205/0023* (2013.01); *B31D 2205/0047* (2013.01); *B65H 2402/443* (2013.01); *B65H 2801/63* (2013.01)

(58) Field of Classification Search
USPC ..... 493/464, 339, 416, 407
See application file for complete search history.

(56) References Cited

U.S. PATENT DOCUMENTS

| | | | | |
|---|---|---|---|---|
| 8,177,156 | B1 | 5/2012 | Rinne | |
| 9,376,280 | B2 * | 6/2016 | Page | B65D 85/672 |
| 11,059,256 | B2 * | 7/2021 | Cheich | B31D 1/0031 |

OTHER PUBLICATIONS

International Preliminary Report on Patentability dated Feb. 11, 2020 for PCT/US2018/045361.

* cited by examiner

COMPACT MANUAL DUNNAGE CONVERSION APPARATUS

RELATED APPLICATIONS

This application is a national phase of International Application No. PCT/US2018/045361, filed Aug. 6, 2018 and published in the English language, and which claims priority to U.S. Application No. 62/541,826 filed Aug. 7, 2017, both of which are hereby incorporated herein by reference in their entireties.

FIELD OF THE INVENTION

This invention relates generally to a dunnage conversion apparatus and method for converting a sheet material into a dunnage product, and more particularly to a dunnage conversion apparatus and method that expands a pre-slit sheet material.

BACKGROUND

In the process of shipping one or more articles from one location to another, a packer typically places some type of packing material in a shipping container, such as a cardboard box, along with the article or articles to be shipped. The packing material, also referred to as dunnage, may be used to wrap the articles, or to partially or completely fill the empty space or void volume around the articles in the container. By filling the void volume, the packing material prevents or minimizes movement of the articles that might lead to damage during the shipment process. The packing material also can perform blocking, bracing, or cushioning functions. Some commonly used packing materials are plastic foam peanuts, plastic bubble pack, air bags, and converted paper packing material.

Unlike most plastic packing products, converted paper packing material is an ecologically-friendly packing material that is recyclable, biodegradable, and composed of a renewable resource. Expandable slit sheet paper packing material is useful as a cushioning material for wrapping articles and as a void-fill material for packing. The term expanding, as used herein, refers to a three-dimensional expansion, or a volume expansion. When the slit sheet paper is stretched in a direction transverse the direction of the slits, the paper deforms, increasing in length and thickness. This stretching and increase in thickness, and volume, more particularly, of the slit sheet paper packing material is referred to as expansion. The material expands in length and thickness while decreasing in width, to yield about a twenty-fold increase in volume and comparable decrease in density. Slit sheet paper packing material, and an exemplary manufacturing thereof, are described in greater detail in U.S. Pat. Nos. 5,667,871 and 5,688,578, the disclosures of which are hereby incorporated herein by reference in their entireties.

SUMMARY OF THE INVENTION

While many dunnage conversion machines produce an adequate dunnage product, existing dunnage conversion machines and dunnage products are not ideal for all applications. The present invention provides a manually-operated dunnage conversion apparatus that is compact, easy to load and use, and is relatively simple and inexpensive to fabricate. The dunnage conversion apparatus can also be used with a pre-slit expandable sheet material to dispense an expanded dunnage product having both cushioning and void-fill characteristics, while occupying a reduced volume for transport and operation.

More specifically, the present invention provides a dunnage conversion apparatus that includes a housing, a support mounted in the housing and configured to support a supply of sheet material for dispensing from the dunnage conversion apparatus, and a guide member downstream of the support and providing a resilient surface across which the sheet material may be drawn to restrict tearing of the sheet material as it is drawn from the dunnage conversion apparatus.

The guide member may be coupled to the housing.

The housing and the guide member may be made of paperboard.

A portion of the guide member may be positioned to bend outwardly from the housing when the sheet material is drawn across the guide member.

The dunnage conversion apparatus may further include a tensioning assembly coupled to the housing and to the support for applying a compressive force between opposite axial sides of the housing.

The dunnage conversion apparatus may further include an adhesive strip adhered to the bottom of the housing, and including a removable liner that is removable to secure the housing to a work surface.

The dunnage conversion apparatus may be in combination with the supply of sheet material, including an expandable sheet material having a plurality of slits configured to expand under tension applied in a feed direction that is transverse a length dimension of the slits. The supply of sheet material in combination with the dunnage conversion apparatus may include the plurality of slits arranged in a plurality of longitudinally-spaced rows that extend in a direction transverse the feed direction.

The dunnage conversion apparatus may be further in combination with a supply of separator sheet material supported in the housing.

The dunnage conversion apparatus may further include a mounting bracket wrapped about the housing to engage a work surface on which the apparatus is positioned.

The present invention further provides a dunnage conversion apparatus including a housing, a support mounted in the housing and configured to support a supply of sheet material for dispensing from the dunnage conversion apparatus, and a tensioning assembly mounted in the housing and configured to apply a compressive force between opposite axial sides of the housing to control the force necessary to dispense sheet material from the supply.

The dunnage conversion apparatus may be in combination with the supply of sheet material, and the tensioning assembly may be configured to apply a compressive force between opposite axial end faces of the supply.

The tensioning assembly may be configured to compress an axial side of the housing between the tensioning assembly and the support.

The opposite axial sides of the housing may be each coupled between an opposite end of the tensioning assembly and the support.

At least a portion of one of the axial sides captured between the tensioning assembly and the support may be configured to float relative to the remainder of the housing.

An axial end face of the housing may include an access opening permitting access to an axial side of the tensioning assembly.

The tensioning assembly may extend into a center core of the support between opposite axial ends of the support.

The dunnage conversion apparatus may further include a tool for engaging an axial end of the tensioning assembly for gripping the tensioning assembly during adjustment of a tension of the tensioning assembly.

The supply of sheet stock in combination with the dunnage conversion apparatus may include a plurality of slits arranged in a plurality of longitudinally-spaced rows that extend in a direction transverse the feed direction.

The dunnage conversion apparatus may be further in combination with a supply of separator sheet material supported in the housing.

The present invention also provides a method of manually dispensing an expanded slit sheet material using the dunnage conversion apparatus in combination with a supply of expandable sheet material. The method includes the steps of (a) pulling the sheet material at a location adjacent an output of the apparatus in a direction outwardly from the apparatus, (b) adjusting the compressive force of the tensioning assembly, and (c) expanding the expandable sheet material via tension between the pulling force at the output and the compressive force applied to opposite axial end faces of the supply by the tensioning assembly.

The present convention even further provides a dunnage conversion apparatus including a housing, a support means coupled to the housing for supporting a supply of expandable sheet material, a tensioning means for applying a compressive force between opposite axial ends of the housing, and a guiding means disposed downstream of the support means for providing a resilient surface across which the sheet material may be drawn to restrict tearing of the sheet material as it is drawn from the dunnage conversion apparatus.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

The annexed drawings, which are not necessarily to scale, show various aspects of the disclosure.

DETAILED DESCRIPTION

Figure 1:
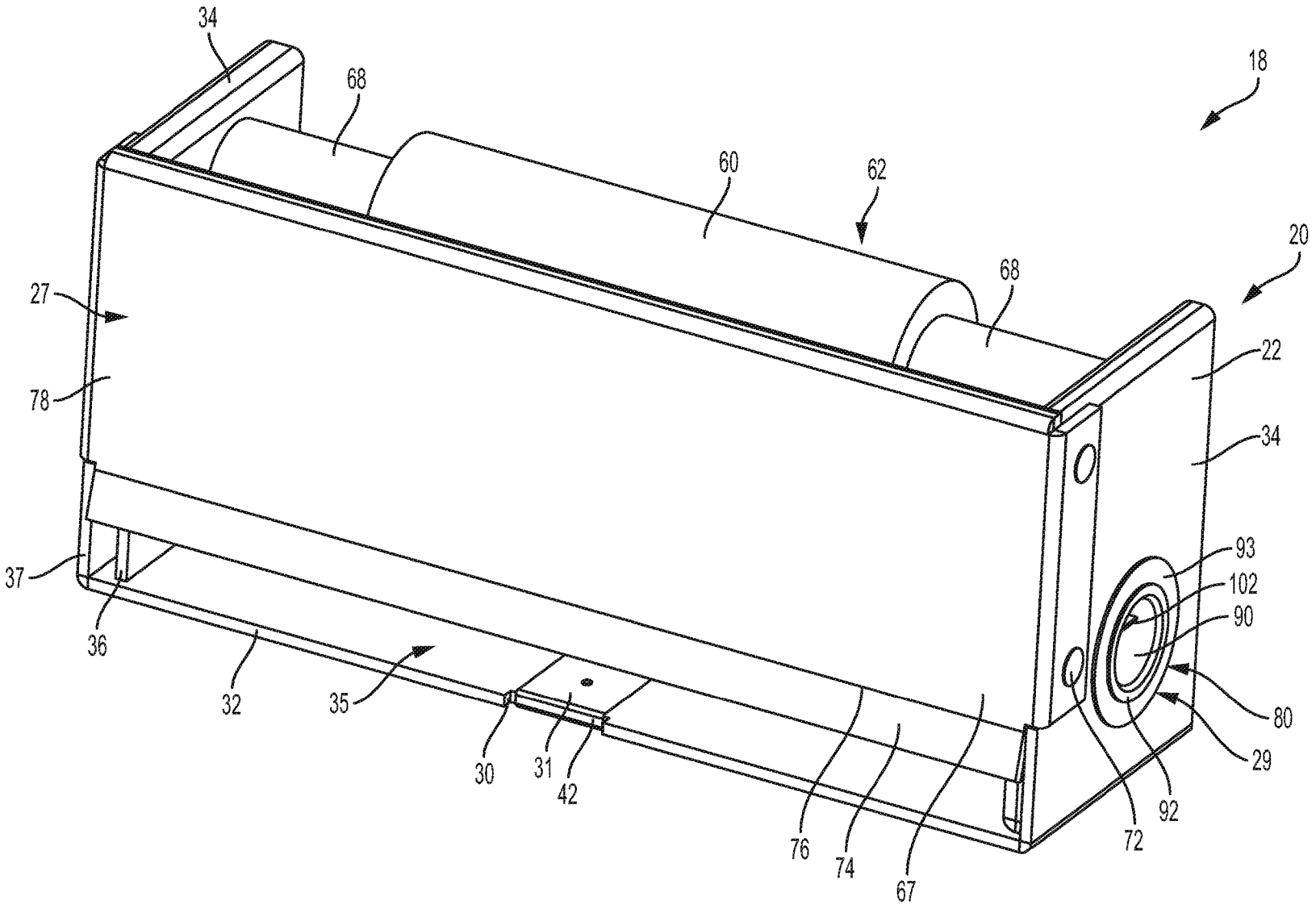
FIG. 1 is a front orthogonal view of an exemplary dunnage conversion system provided in accordance with the present invention.
Figure 2:
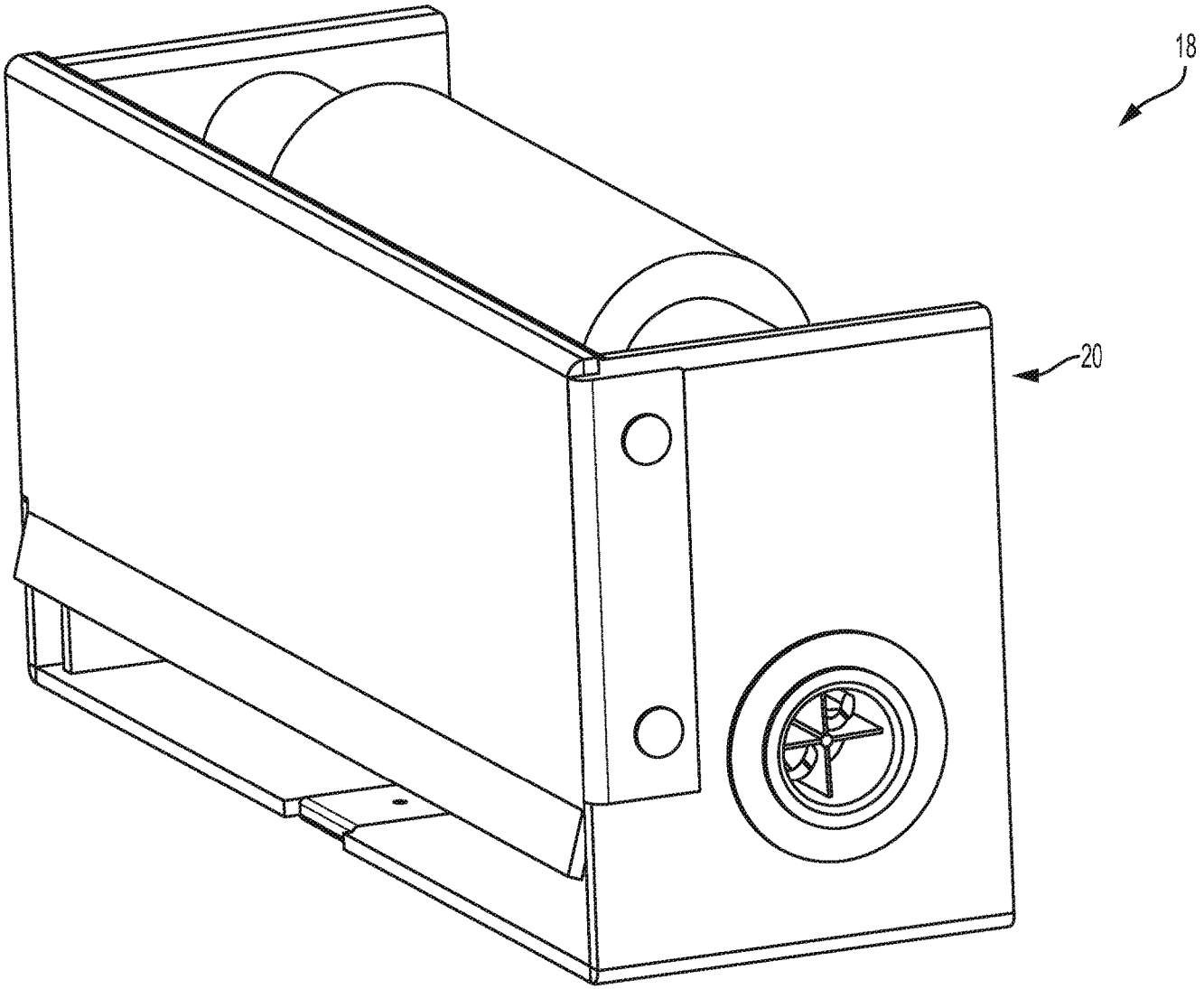
FIG. 2 is another front orthogonal view of the exemplary dunnage conversion system of FIG. 1.

The present invention provides an improved low-cost and low-volume apparatus for manually converting a supply of slit sheet material into an expanded dunnage product while facilitating uniform expansion under constant tension, in a simple and easily manufactured assembly.

Referring now to the drawings in detail, FIGS. 1 to 15 illustrate an exemplary dunnage conversion system 18 including a dunnage conversion machine or apparatus 20, a supply 24 of expandable sheet material 26, a separator supply 62 of separator sheet material 60, and a tool 104. The dunnage conversion apparatus 20 includes a housing 22 (also herein referred to as a frame) and supporting means 23 for supporting the supply 24 sheet material 26 within the housing 22. The apparatus 20 also includes guiding means 27 for guiding the sheet material 26 downstream of the supporting means 23. The guiding means 27 guides the sheet material 26 during expansion as the sheet material 26 is advanced in a feed direction from the supporting means 23 to the guiding means 27. A tensioning means 29 is further provided to change a compressive force applied to opposed axial end faces of the supply 24 of unexpanded sheet material on the supporting means 23, to thereby control rotational resistance acting on the supply 24. The apparatus 20 may be provided in combination with the supply 24 of sheet material 26. The sheet material 26, also herein referred to as sheet material, slit sheet material, or unexpanded slit sheet material, expands in length and thickness when pulled from the supply 24 to form a relatively less dense, larger volume, expanded dunnage product 28 (FIG. 14). As further explained below, the conversion apparatus 20 enables an operator to manually produce an expanded dunnage product 28 from the relatively more compact unexpanded sheet material 26 at a lower cost than a powered dunnage converter.

The housing 22 of the conversion apparatus 20 is generally rectangular, and defines a partially closed volume for retaining the supply of sheet material 24 and the supporting means 23. The housing 22 includes at least a bottom portion 32 extending between opposite axial sides 34. The housing 22 may be made of cardboard, or alternatively, may be made of another form of paper, such as paperboard.

The housing 22 may include holding means for holding the housing 22 in place during use. For example, one or more strips of adhesive, such as double-sided adhesive tape 39, may be secured to the bottom portion 32 of the housing 22 and covered with a removable release liner until ready for use in securing the housing 22 to a work surface. In the depicted embodiment, both the adhesive tape 39 and a mounting member, such as a mounting bracket 31, are illustrated.

The mounting bracket 31 includes a vertically extending end 41, such as downwardly extending end, disposed opposite a retaining end 42. The retaining end 42 has a slot for receiving the housing 22, such as the bottom portion 32. The mounting bracket 31 is shown wrapped about an inner surface of the bottom portion 32, such that the bottom portion 32 will be disposed between the bracket 31 and a work surface. The retaining end 42 is wrapped about a front end of the apparatus 20. The bracket 31 is received in one or more slots 30 of the bottom portion 32 to aid in retaining the bracket 31 relative to the housing 22. The illustrated bottom portion 32 includes a pair of oppositely disposed slots at the front and back of the apparatus 20.

As illustrated, the bracket 31 is disposed such that the vertically extending end 41 is a downwardly extending end that is positioned to engage a side or end of a work surface when sheet material 26 is dispensed from the supply 24. The bracket 31 may be reversed 180 degrees from the orientation depicted, where suitable, such that the vertically extending end 41 is disposed at the front of the apparatus 20.

Further, the bracket 31 may also be flipped 180 degrees about its long axis and positioned to rest against a bottom surface of the bottom portion 32, such that the bracket 31 is disposed between a work surface and the bottom portion 32. In this configuration, the mounting bracket 31 may be attached to the work surface in a suitable manner, such as via a fastener or by one or more strips of adhesive that may be already secured to the mounting bracket 31. The vertically extending end 41 will be an upwardly extending end. The housing 22 may exert a force against the upwardly extending end 41 in such configuration, when the sheet material 26 is dispensed from the supply 24.

Any one or more of the mounting bracket 31, adhesive tape 39, or other suitable holding means may be used to help to hold the housing 22 to a work surface, such as a table top, during use to resist movement of the apparatus 20 when the sheet material 26 is dispensed. This is particularly helpful when the supply 24 of sheet material 26 is nearly exhausted, reducing the weight of the apparatus 20 and thus also the resistance of the apparatus 20 to a pulling force on the sheet material 26.

The housing bottom portion 32 extends between opposite axial sides 34 that are laterally-spaced apart from one another via the bottom portion 32. The axial sides 34 extend vertically and generally orthogonally in relation to the bottom portion 32. The bottom portion 32 and the axial sides 34 can be a single, unitary structure as shown, or can be formed of separate, intercoupled components in other embodiments. Each of the opposite axial sides 34 includes a slot for receiving the tensioning means 29. Each of the opposite axial sides 34 also includes an inwardly facing slot for receiving and supporting the supporting means 23. The housing 22 has an outlet opening 35 extending between the opposite axial sides 34 through which the sheet material 26 may be drawn.

One of the axial sides 34 includes an inner portion 36 coupled to an outer portion 37, which is in turn coupled to the bottom portion 32. As shown, the inner portion 36, the outer portion 37, and the bottom portion 32 are integral with one another and are hingedly connected to one another. The inner portion 36 is hingedly connected to the outer portion 37 and is not directly connected to, but is supported by, the bottom portion 32, such that the inner portion 36 is enabled to float relative to the remainder of the housing 22. For example, the inner portion 36 may be moved between the outer portion 37 and the opposite axial side 34, relative to the bottom portion 32 and to the outer portion 37. The inner portion 36 may float generally along the rotation axis 33 (FIG. 15) of the support member 38, in response to operation of the tensioning means 29. In addition, the inner portion 36 is further configured to support the supporting means 23.

The supporting means 23 includes one or more supports 38 positioned within the housing 22 to support or guide the sheet material 26 as it is drawn from the supply 24. The depicted support 38 is a hollow core extending between the opposite axial sides 34, such as between the inner portion 36 of a first axial side 34 and the opposite second axial side 34. The support 38 and the axial sides 34 can be formed of separate, intercoupled components as shown, or can be a single, unitary structure, in other embodiments. The stock material supporting means 23, including the support 38, generally also is formed of cardboard or other paper-based product. In other embodiments, the supporting means 23 may include a receiving portion for being positioned beneath the supply 24 and for receiving and supporting the supply 24. The receiving portion may include rotating members for aiding in rotation of the supply 24 where the supply is in the form of a roll. The receiving portion may define a cavity for receiving the supply 24.

Figure 13:
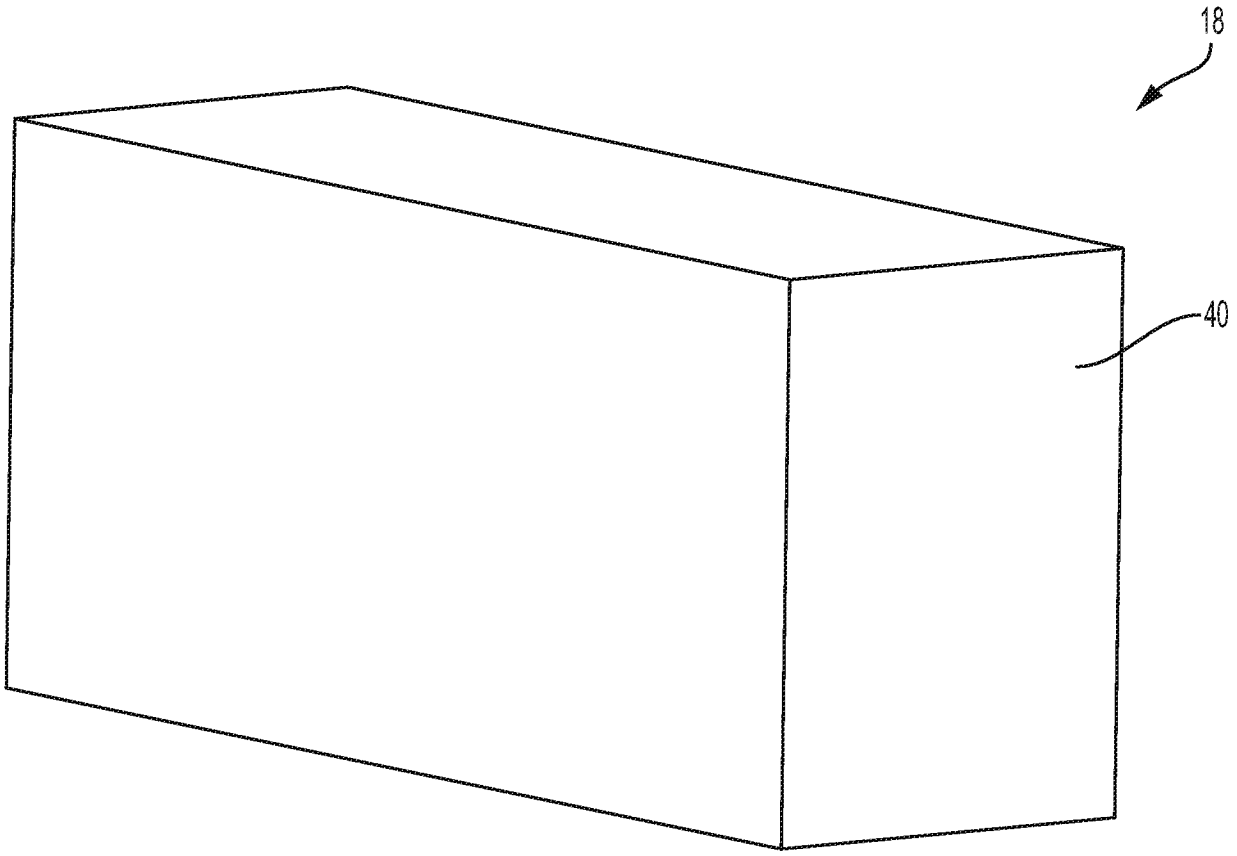
FIG. 13 is a front orthogonal view of the exemplary dunnage conversion system of FIG. 1, shown with a cover for storage and shipment.
Figure 14:
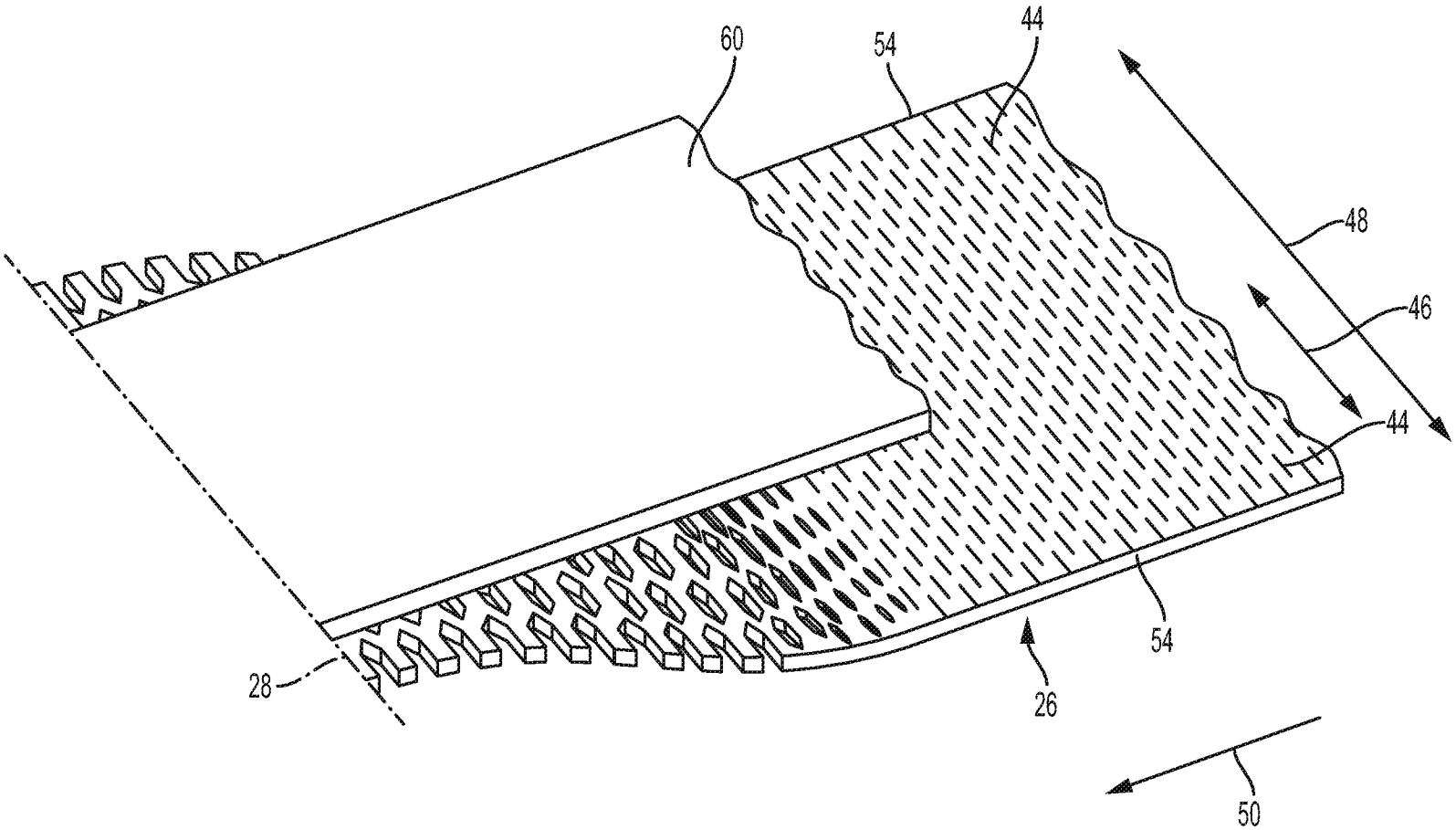
FIG. 14 is a schematic representation of a slit sheet material provided by the invention, illustrating the expansion of the sheet to an expanded dunnage product.

A cover or lid 40, such as that shown in FIG. 13, may be provided to further protect the apparatus 20 during shipment and storage, and may be removed during use. The cover 40 can be made of the same material as the housing 22, such as cardboard, paperboard, or other paper-based material, and covers a top and at least a portion of the axial sides 34 of the housing 22. As depicted, the cover 40 of the apparatus 20 covers each of the axial sides 34 and the supply 24, and may cover at least part of the bottom portion 32 in other embodiments. During shipping or other transport, the tool 104 and mounting bracket 31 may be stored between the apparatus 20 and the cover 40.

Referring briefly to FIG. 14, the sheet material 26 in combination with the apparatus 20 has a plurality of rows of slits 44, and typically includes one or more plies. The slits 44 have a length dimension 46 that generally is parallel to a width dimension 48 of the sheet material 26, transverse to the feed direction 50 from which the sheet material 26 is pulled from the supply 24. The feed direction 50, from the supply 24 to the outlet opening 35 through which the sheet material 26 is pulled, also may be referred to as a downstream direction. An upstream direction is opposite the downstream direction.

The sheet material 26 has a plurality of longitudinally-spaced, transversely-extending rows of slits 44. Typically, the slits 44 are periodically, and typically equally, spaced from one another. Though in other embodiments the rows may be otherwise suitably arranged relative to one another. The slits 44 are intermittently dispersed across the rows, with the slits 44 of each row generally being staggered in relation to slits of directly adjacent rows. Across each row of slits 44, there may be a greater length of combined slits 44 than a length of un-slit portions disposed between slit endpoints, providing for an optimum amount of expansion of the sheet material 26. The slits 44 may be formed by cutting the sheet material 26, or otherwise weakening the sheet material 26 intermittently in the transverse direction along each row across the sheet material 26 so that the sheet material 26 separates across the slit under longitudinal tension provided in the feed direction 50. The apparatus 20 provided by the invention may be used with a supply 24 of sheet material 26 with a different arrangement of slits in other embodiments.

This exemplary sheet material 26 is configured for expanding in one or more dimensions, also herein referred to as volume expansion or volumetric expansion. For example, when the sheet material 26 is stretched in the feed direction 50 transverse the direction of the slits 44, the sheet's longitudinal length and its thickness increase, while the sheet's lateral width dimension 48 decreases.

The thickness of the slit sheet material 26 can increase by an order of magnitude, or more, relative to its original thickness when stretched in this manner. The increased thickness as the sheet material 26 is stretched longitudinally is caused at least in part via the portions of the sheet material 26 between the rows of slits 44 rotating relative to the plane of the unexpanded sheet material 26 and extending out of the plane of the formerly planar sheet. The thickness dimension extends in a normal direction relative to a face of the sheet material 26. The normal direction is defined as generally orthogonal to the sheet's longitudinal length and generally orthogonal to a lateral extent between lateral edges 54 of the sheet material 26.

To summarize, as compared to the unexpanded slit sheet material 26, the expanded sheet material 26 (also referred to as the dunnage product 28) has an increased length and thickness and reduced width. The longitudinal stretching and increase in thickness results in the volumetrically expanded dunnage product 28. The increased volume allows the expanded dunnage product to serve as a perforate protective void-fill or cushioning wrap for packaging articles in containers.

An exemplary sheet material 26 includes paper, such as kraft paper, and more particularly, includes a single-ply kraft paper. Suitable kraft paper may have various basis weights, such as twenty-pound or forty-pound, for example. In some embodiments, the sheet material 26 may be laminated or may include any other suitable material such as another paper, plastic sheets, metal foil, or any combination thereof.

Turning again to FIGS. 1-15, as shown, the sheet material 26 generally may be supplied in one or more rolls. The depicted sheet material 26 in each roll is wound about the supply support 38. In other embodiments, the sheet material 26 may be wound about a separate hollow core that is itself received on the supply support 38. The supply 24 may rotate about the central axis 33 (FIG. 15) parallel to the width dimension 48 as the sheet material 26 is unwound from the roll in the feed direction 50 transverse the central axis 33. The hollow core may be made of paperboard. In other embodiments, the supply 24 of sheet material 26 may be additionally or alternatively provided in another suitable arrangement, such as in a fan-folded stack, where the sheet material is alternatingly folded into a stack of generally rectangular pages with the slits generally parallel to fold lines in the sheet material. The illustrated exemplary sheet material 26 with its plurality of slits 44 (FIG. 14) is configured to expand along the feed direction 50 as it is drawn through the housing 22 of the apparatus 20 from the supporting means 23 to the guiding means 27.

The sheet material 26 may be drawn along with a separator sheet material 60 used as a separator sheet between the resultant dunnage product 28 and a product to be protected by the dunnage product 28. Accordingly, the dunnage conversion system 18 may further include a separator supply 62 of separator sheet material 60 in combination with the apparatus 20 and the supply 24. An exemplary separator sheet material 60, also herein referred to as interleaf paper, may be a tissue paper, thin kraft paper such as thinner than the slit sheet material 26, plastic, a combination thereof, etc. The interleaf paper is generally non-expandable.

Like the supply 24, the separator supply 62 may be provided as a roll, such as wound about a hollow core 61 that may be received on a respective separator support 64. The separator supply 62 may rotate about a central axis 66 (FIG. 15) as the separator sheet material 60 is unwound from the roll in the feed direction 50 transverse the central axis 66. The illustrated support 64 is a hollow core extending between the axial sides 34. The support 64 is received in corresponding slots of the axial sides 34 of the housing 22, such as in the inner portion 36 of the first axial side 34 and in the opposite second axial side 34. One or more spacing collars 68 may be disposed on the illustrated support 64 for spacing the supply 62 centrally along the support between the axial sides 34.

Additionally, or alternatively, the separator supply 62 may be provided in a fan folded stack, and an associated supply support may include a shelf for supporting the stack.

Downstream of each of the separator supply 62 and the sheet material supply 24, the guiding means 27 is disposed mounted to the housing 22. The guiding means 27, such as a guide member 67, is provided at the outlet 35 for guiding at least the sheet material 26 as it is drawn from the supply 24. The guide member 67 extends between each of the axial sides 34 of the housing 22, such as between the outer portion 37 of a first axial side 34 and the opposite second axial side 34. The guide member 67 generally also is formed of cardboard, paperboard, or other paper-based product. In some embodiments, the guide member 67 may be unitary with the housing 22.

As depicted, couplers 72, such as rivets, fasten opposite axial ends of the guide member 67 to opposite axial sides 34. The coupling provides for support of the axial sides 34 and generally maintains the spacing therebetween. The rivets may be plastic, metal, or another suitable material. Alternatively, the guide member 67 could be coupled to the axial sides 34 via an adhesive.

The guide member 67 includes a resiliently movable portion 74, such as a resilient flap 74, against which at least the sheet material 26 is drawn when being advanced in the feed direction 50. At least the sheet material 26, and where desired the separator sheet material 60, may be drawn under the guide member 67, between the bottom portion 32 and the flap 74 of the guide member 67.

As the sheet material 26 is drawn outwardly, the resilient flap 74 may also be drawn outwardly, such as bent outwardly from the housing 22. A hinge location 76 between a guide member coupling portion 78 and the resilient flap 74 provides a rounded contact for the expandable sheet material 26 as it advances in the feed direction 50. The resiliency of the flap 74 also may aid in providing tautness of the sheet material 26 between the guide member 67 and the supply 24, thereby facilitating expansion of the sheet material 26 therebetween. The guide member 67 and the resilient flap 74 further may assist in restricting or preventing wrinkling, tearing, or misalignment of the sheet material 26 between the axial sides 34.

In other embodiments, the guiding means 27 may additionally or alternatively include a cylinder mounted between the axial sides 34 which may or may not rotate relative to the axial sides 34. In such case, an exemplary guide member 67 may include a paperboard tube or rod, or a wooden dowel.

Figure 3:
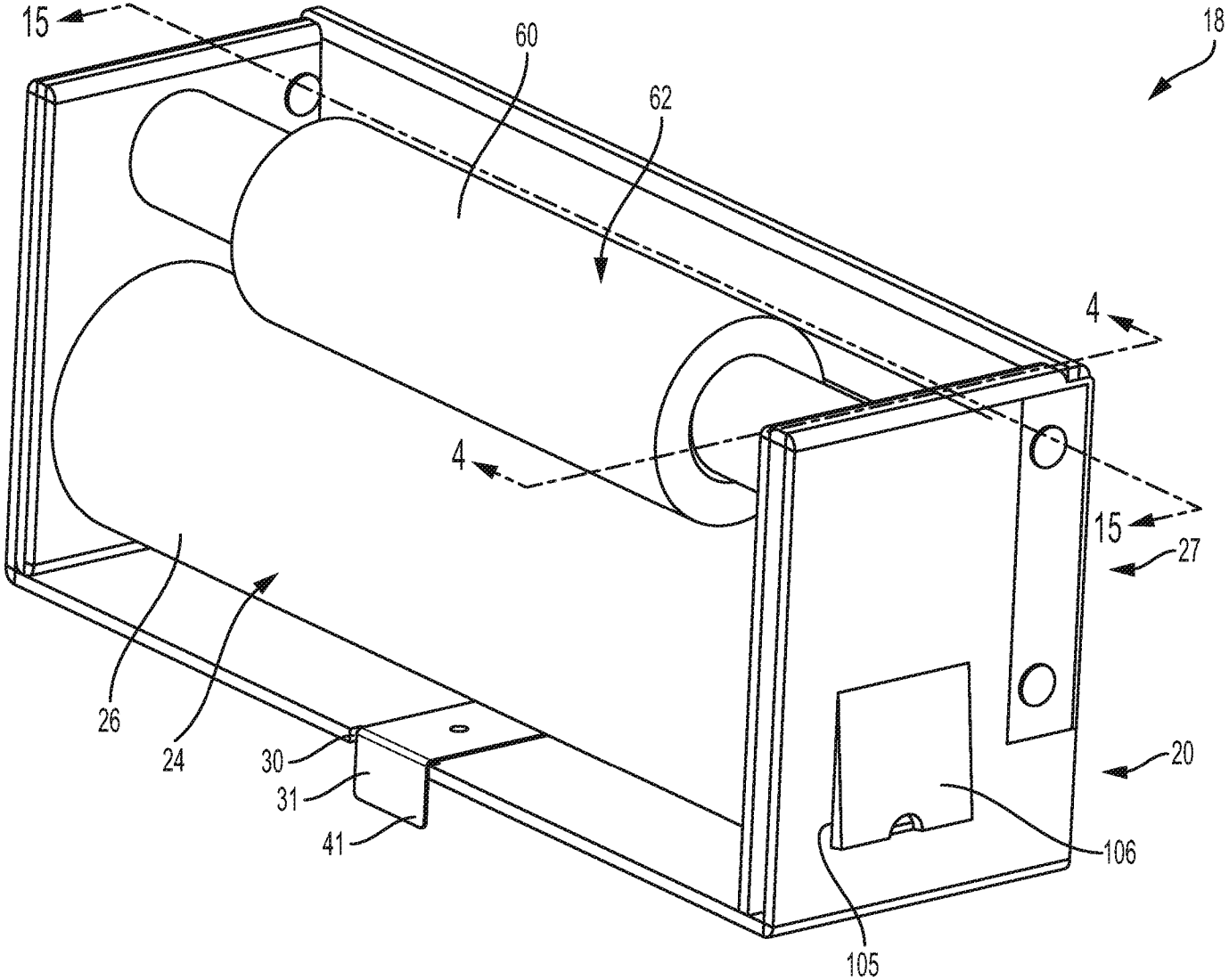
FIG. 3 is rear orthogonal view of the exemplary dunnage conversion system of FIG. 1.
Figure 4:
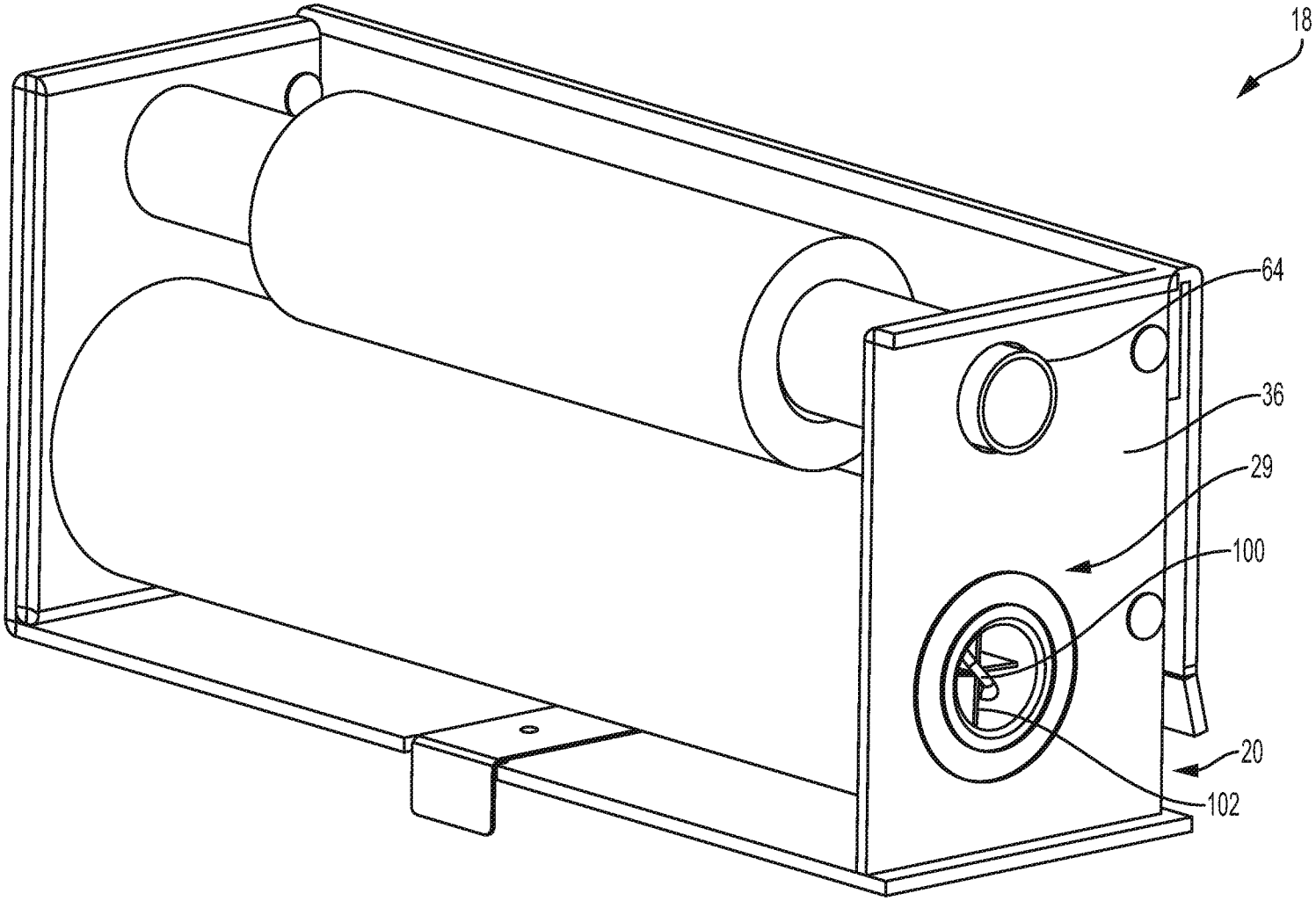
FIG. 4 is another rear orthogonal view of the exemplary dunnage conversion system of FIG. 1, shown partially in cross-section taken along line 4-4 of FIG. 3.
Figure 5:
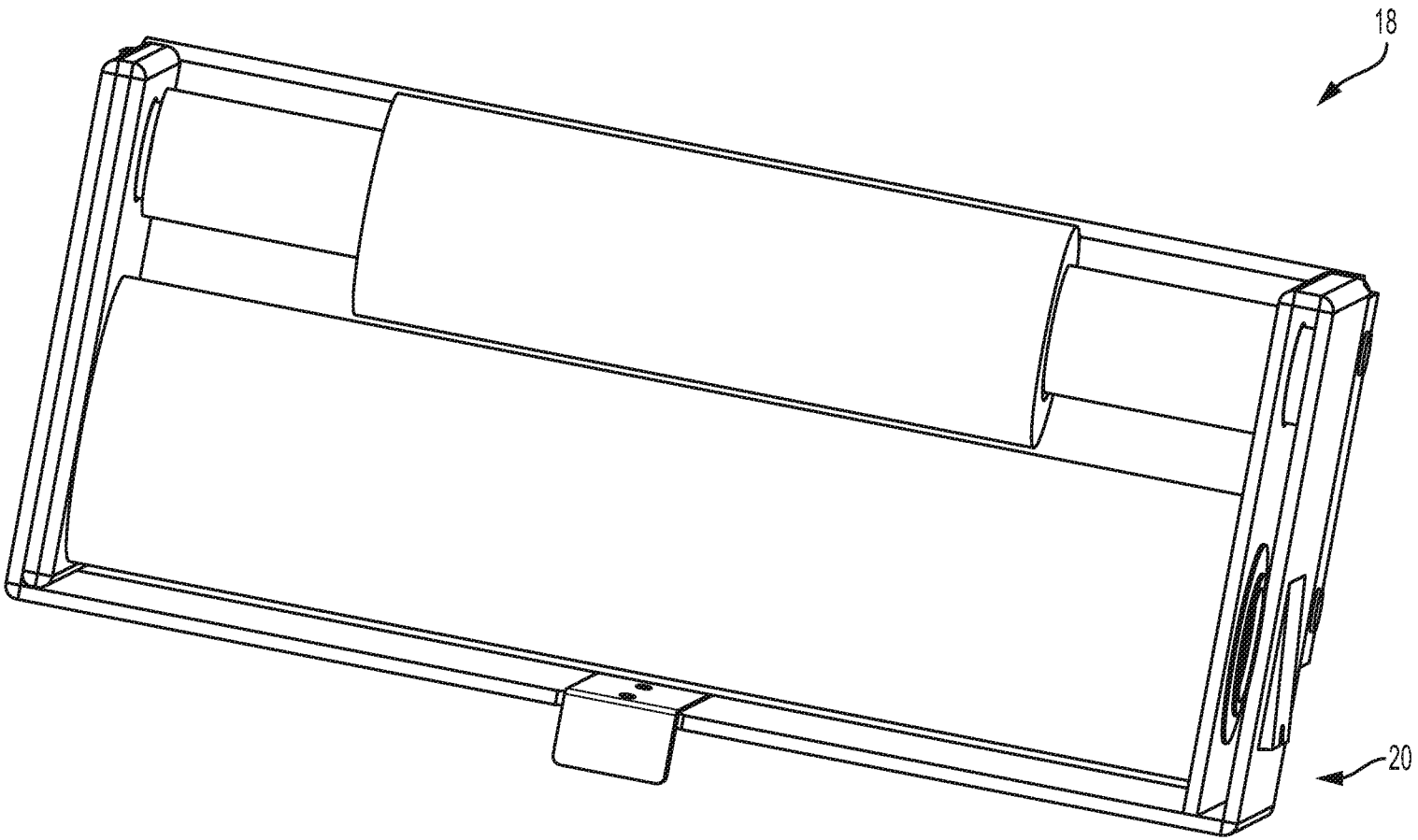
FIG. 5 is yet another rear orthogonal view of the exemplary dunnage conversion system of FIG. 1.
Figure 6:
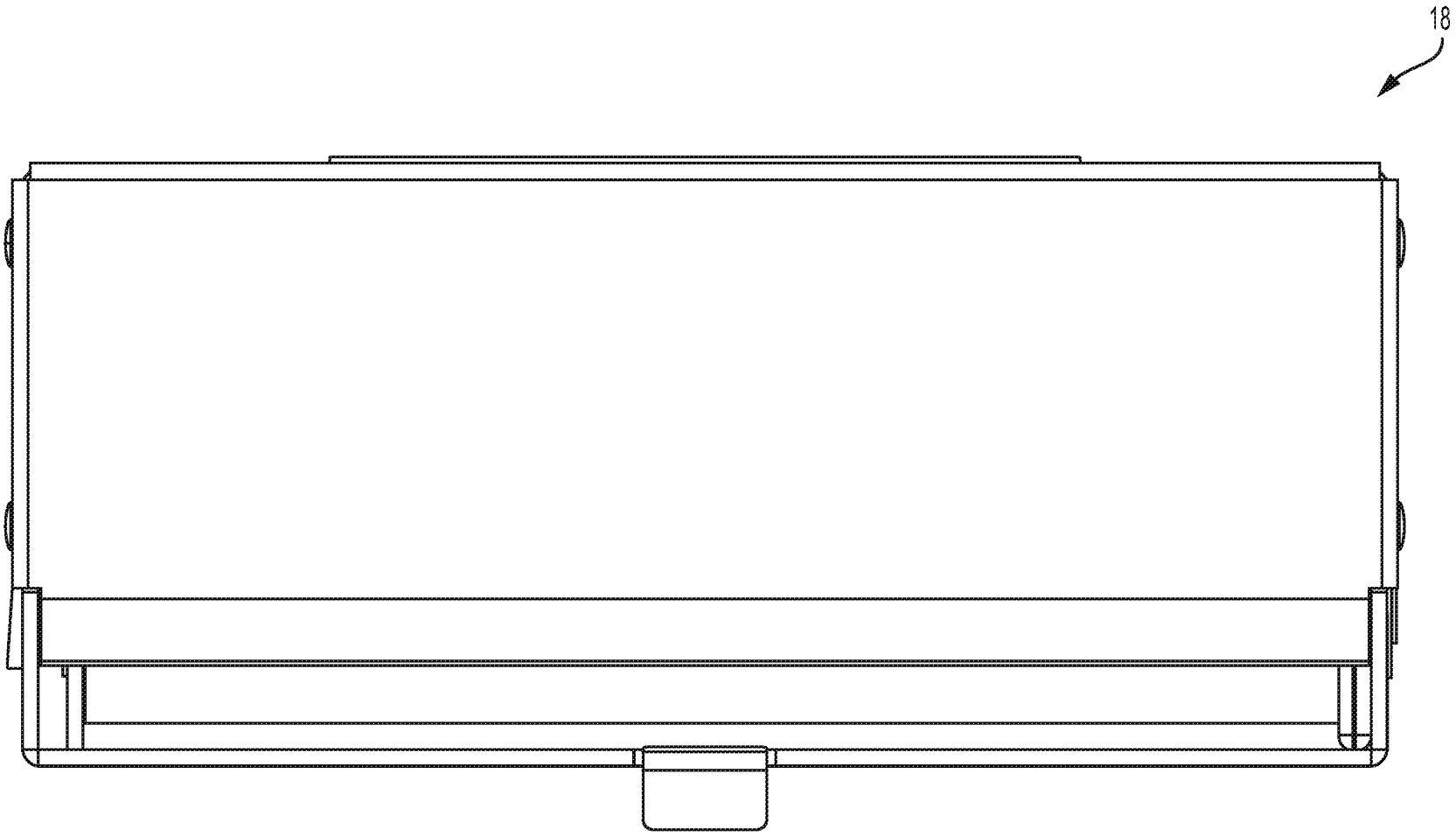
FIG. 6 is a front elevation view of the exemplary dunnage conversion system of FIG. 1.
Figure 7:
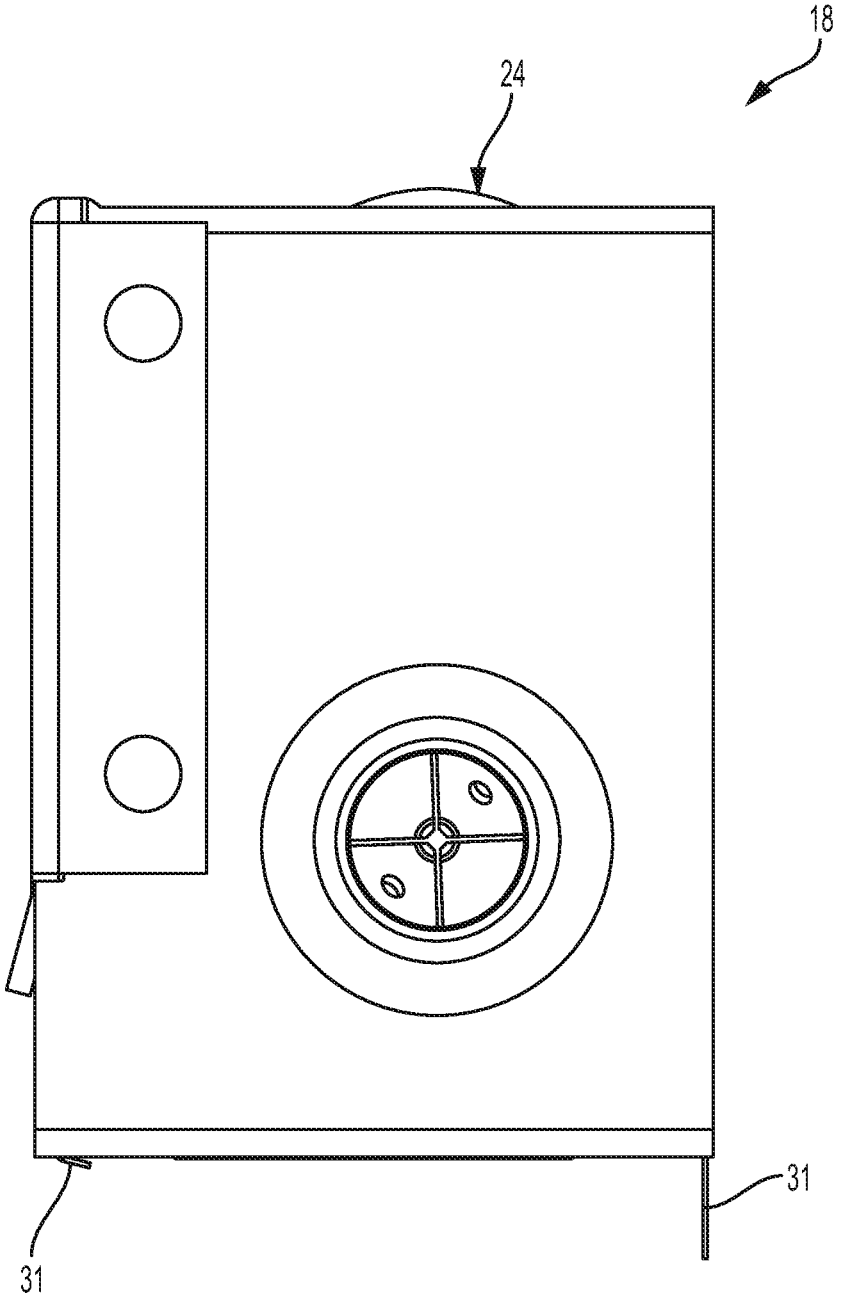
FIG. 7 is a right side elevation view of the exemplary dunnage conversion system of FIG. 1.
Figure 8:
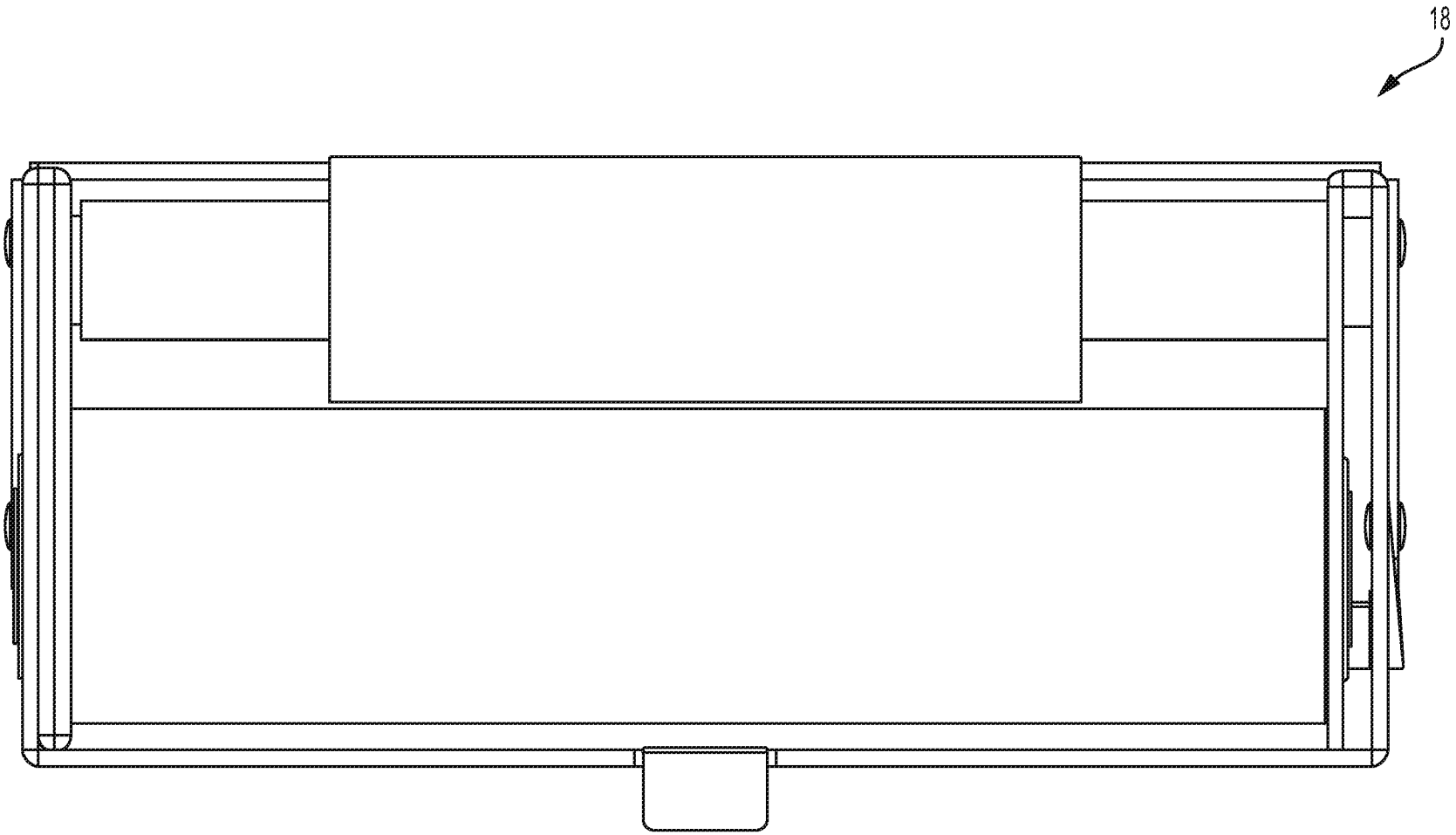
FIG. 8 is a rear elevation view of the exemplary dunnage conversion system of FIG. 1.
Figure 9:
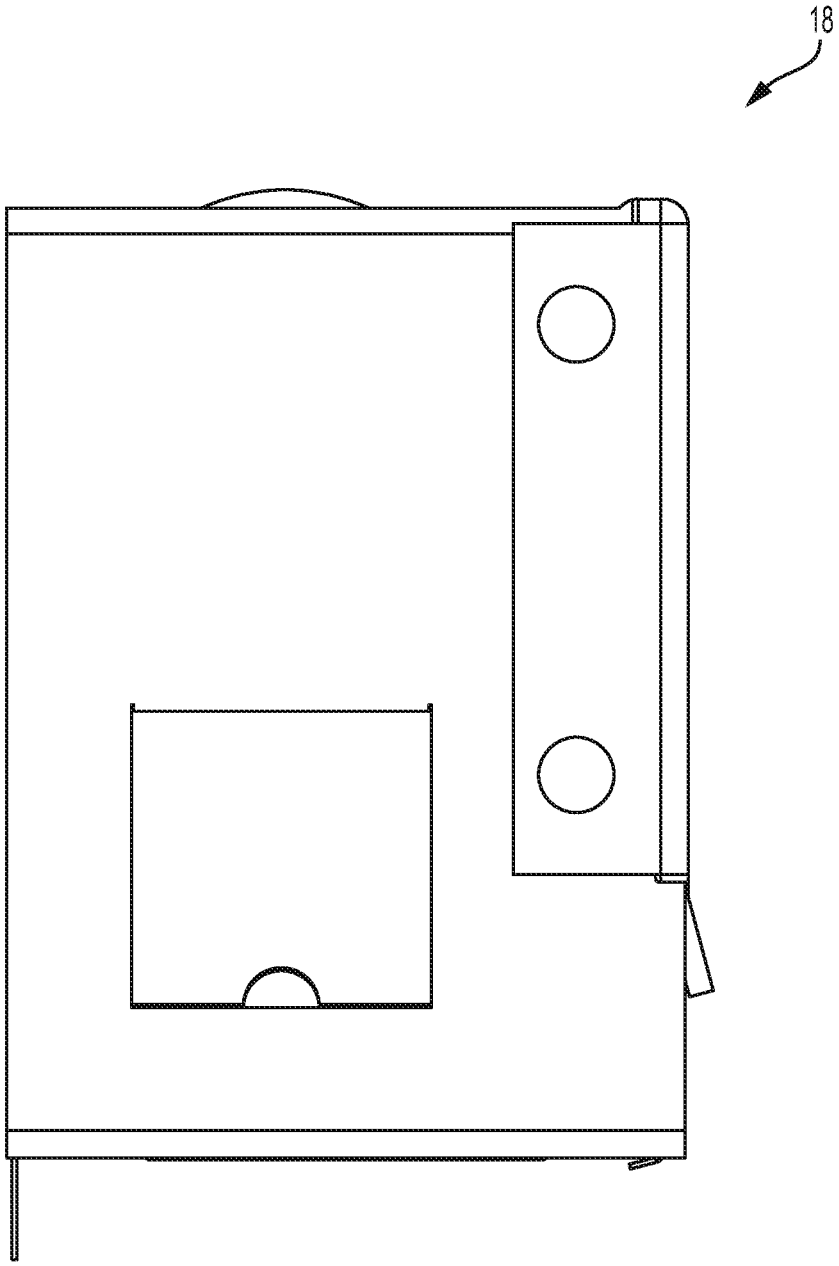
FIG. 9 is left side elevation view of the exemplary dunnage conversion system of FIG. 1.
Figure 10:
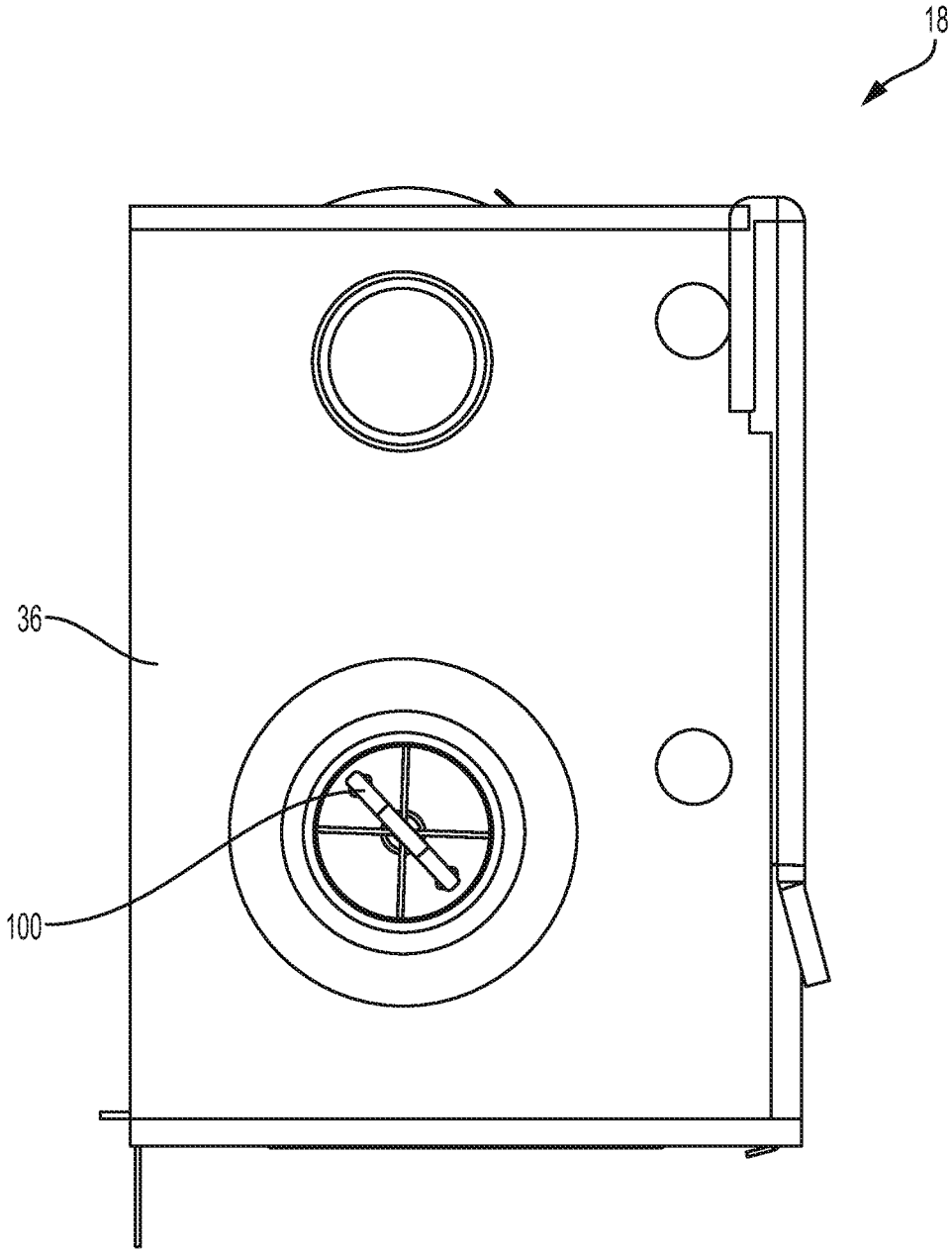
FIG. 10 is yet another side elevation view of the exemplary dunnage conversion system of FIG. 4.
Figure 11:
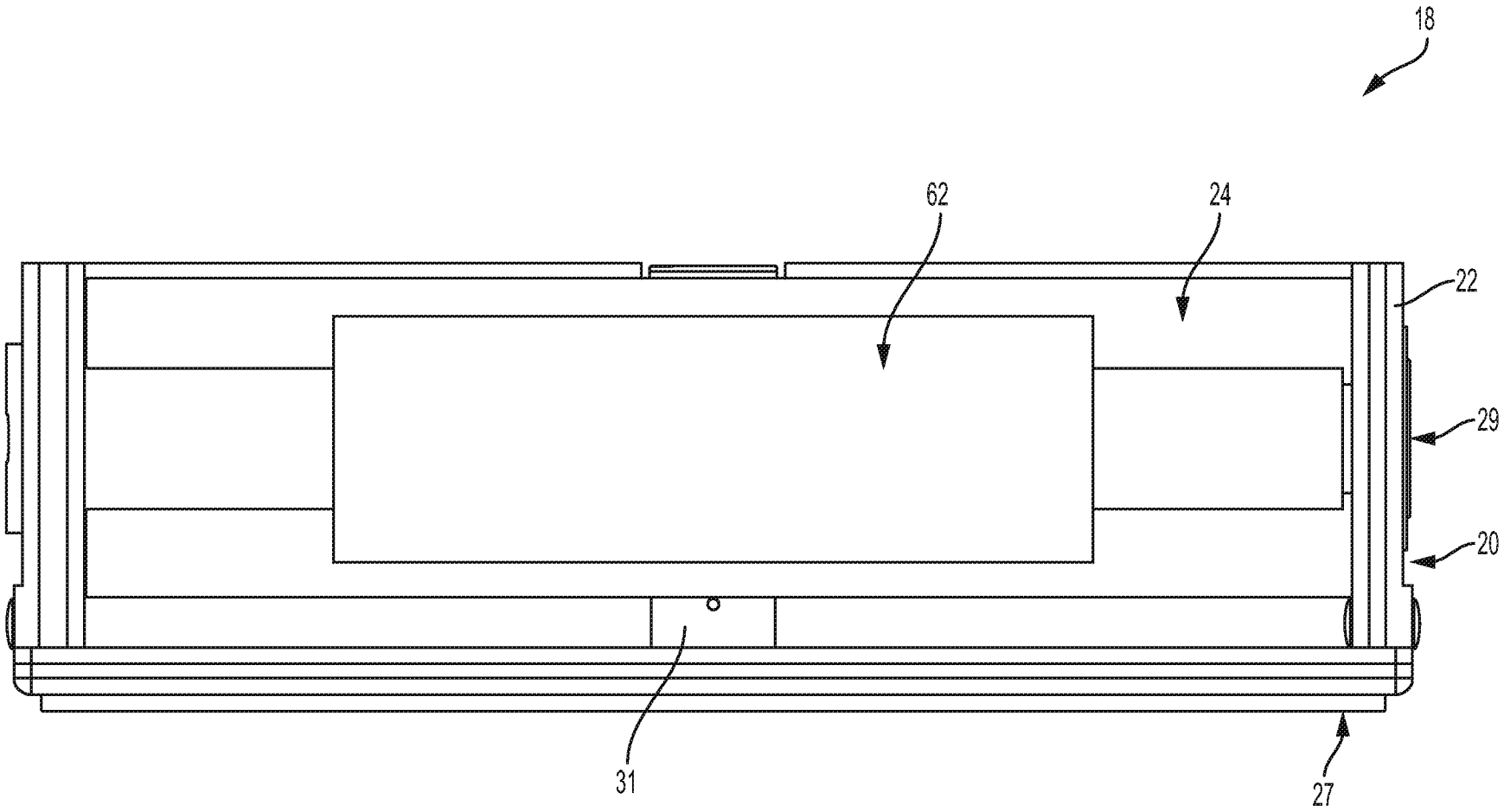
FIG. 11 is a top plan view of the exemplary dunnage conversion system of FIG. 1.
Figure 12:
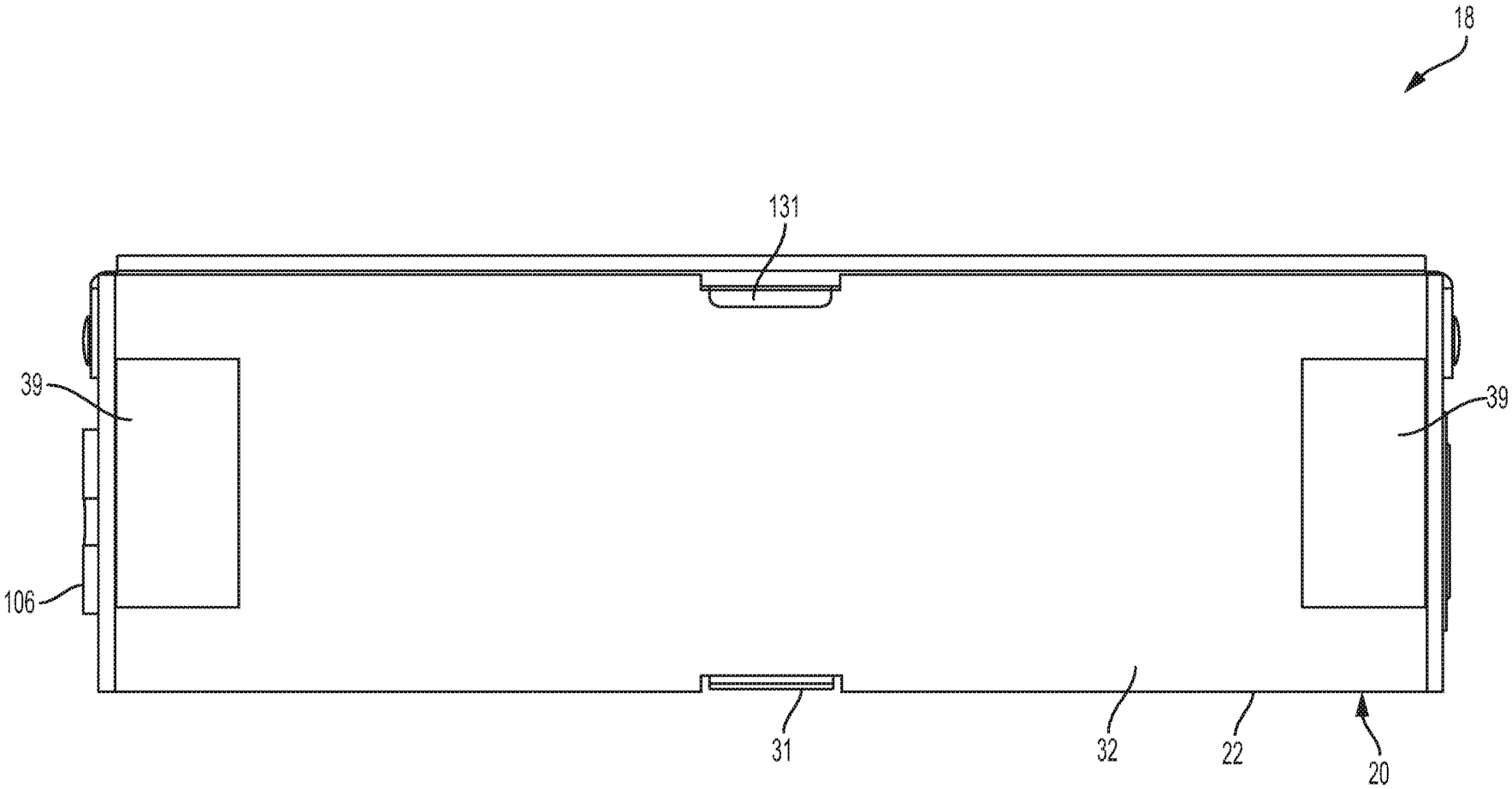
FIG. 12 is a bottom elevation view of the exemplary dunnage conversion system of FIG. 1.
Figure 15:
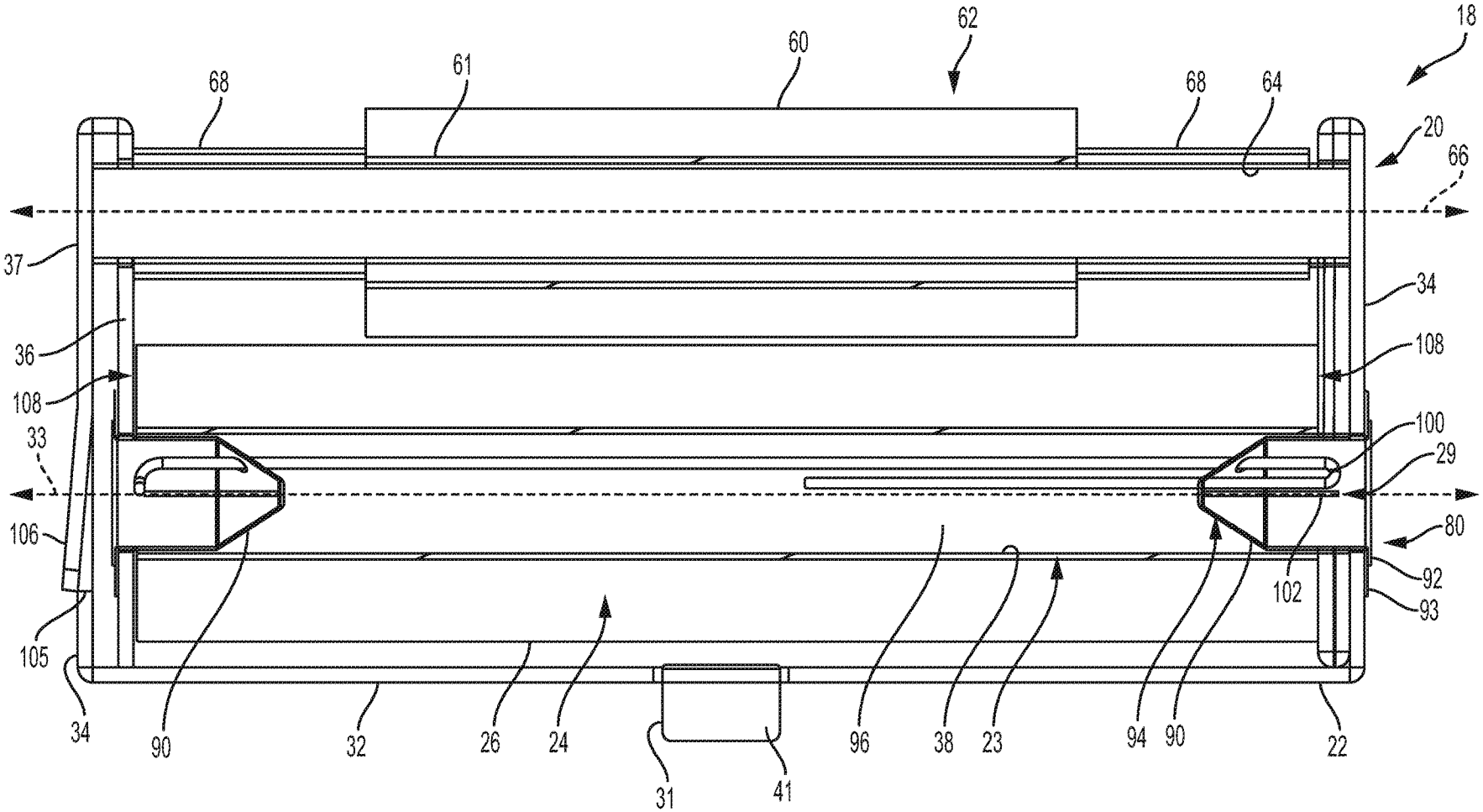
FIG. 15 is a partial cross-sectional view of the exemplary dunnage conversion system of FIG. 1 taken along line 15-15 of FIG. 3 showing a tensioning assembly.

Turning now in particular to FIG. 15, and to FIGS. 3-5, upstream of the guide member 67, tension of the supply 24 is controlled via a tensioning means 29. The depicted tensioning means 29 includes a tensioning assembly 80 that is mounted in the housing 22 and is configured to apply a compressive force between the opposite axial sides 34 of the housing 22 to control the force needed to dispense the sheet material 26 from the supply 24.

The tensioning assembly 80 is coupled between the axial sides 34 at the location of the mounting of the support 38 to the housing 22. Each of the axial sides 34 of the housing 22 are coupled between an opposite end of the tensioning assembly 80 and the support 38. More particularly, the inner portion 36 of the first axial side 34 and the opposite second axial side 34 are coupled by the tensioning assembly 80.

As depicted, the tensioning assembly 80 includes oppositely disposed tensioning core plugs 90 received in corresponding slots of the inner portion 36 of the first axial side 34 and of the second axial side 34. A retaining rim 92 of each of the tensioning core plugs 90 is disposed outwardly of the axial sides 34. A washer 93, such as a paper-based washer, is disposed between the retaining rim 92 and the respective axial side 34. An inner core plug portion 94 of each of the tensioning core plugs 90 is received through the corresponding slots of the axial sides 34 and into a center core cavity 96 the support 38, which is mounted between the axial sides 34. The tensioning core plugs 90 are gripped via friction between the axial sides 34 and the tensioning core plugs 90.

A resilient biasing member 100, such as a plastic cord such as nylon, rubber band, string, wire, rope, etc., that extends through the center core cavity 96 of the support 38 and is coupled between each of the inner core plug portions 94. Particularly, the biasing member 100 is received through corresponding slots in each of the inner core plug portions 94 to form a loop. A loop may not be formed in other embodiments.

Figure 16:
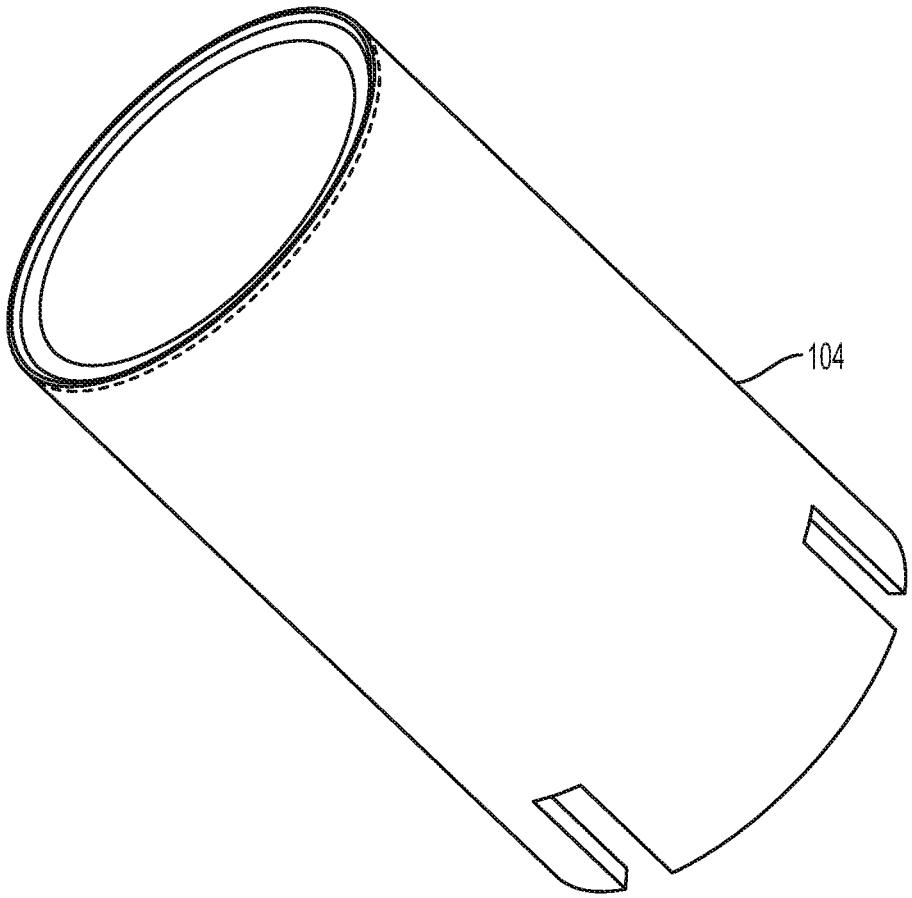
FIG. 16 is an orthogonal view of a tool for use with the tensioning assembly of FIG. 15.
Figure 17:
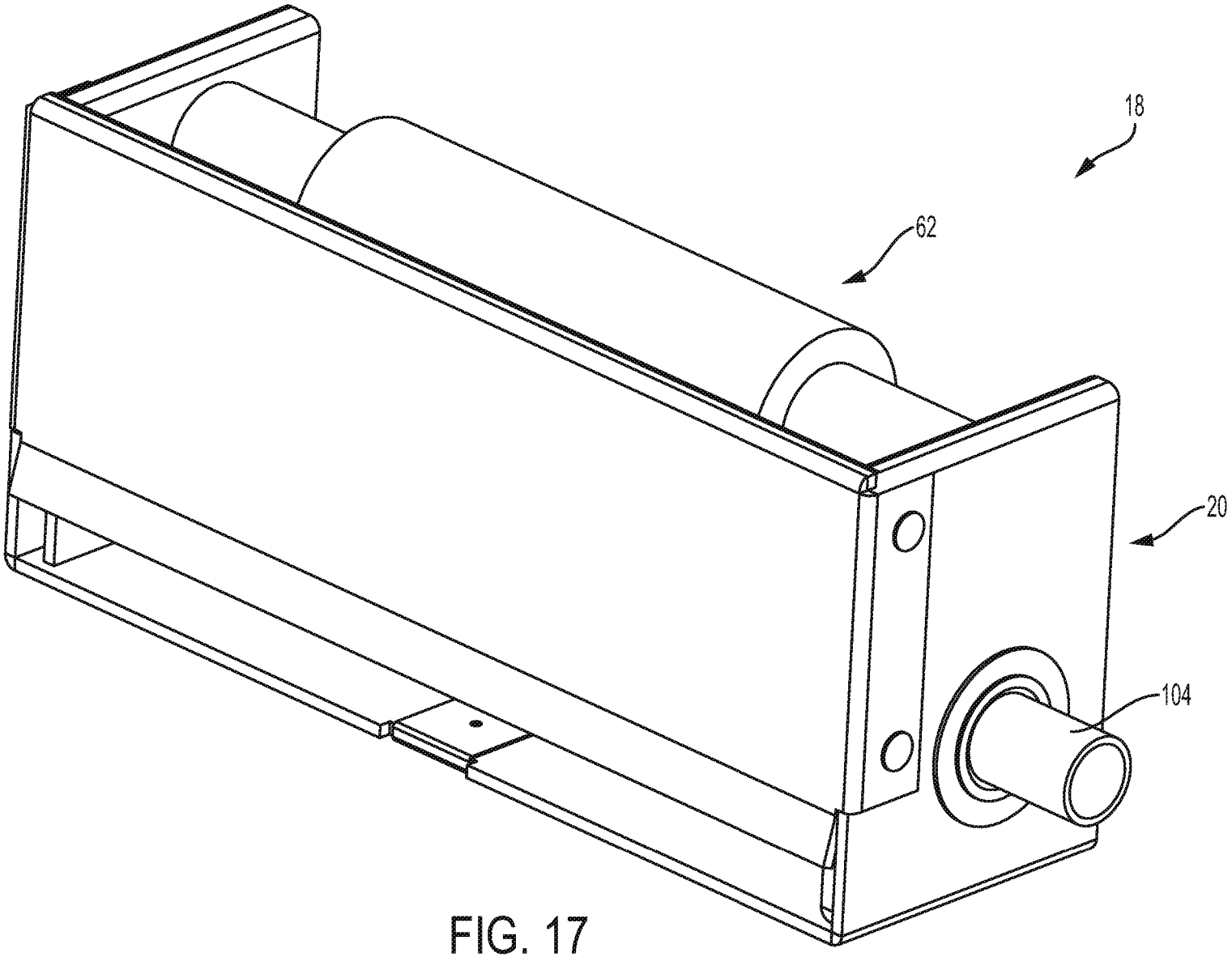
FIG. 17 is an orthogonal view of the exemplary dunnage conversion system of FIG. 15 with the tool of FIG. 16 engaging an axial side of the tensioning assembly of FIG. 15.

At least one of the tensioning core plugs 90, and as depicted both core plugs 90, includes an externally accessible exposed end portion 102, adjacent the retaining rim 92, that is configured to be gripped by a user for twisting or rotating the respective tensioning core plug 90. As shown in FIGS. 16 and 17, a corresponding tool 104 may be used for gripping an axial side of the tensioning assembly 80, such as an end portion 102. One of the tool 104 and the end portion 102 may have one or more slots for receiving one or more keys of the other of the tool 104 and the end portion 102. The depicted tool 104 includes slots, where the end portions 102 include keys. The tool 104 may be made of a paper-based product. A second tool may be used for gripping the opposite end portion 102.

The outer portion 37 of the first axial side 34 includes an access opening 105, and an access door 106 for closing the access opening 105. The access opening enables access through the outer portion 37 to the respective disposed end portion 102. As depicted, the access door 106 is unitary with the outer portion 37 of the first axial side 34, but may be otherwise coupled to the outer portion 37 in other embodiments. Alternatively, the access door 106 may be omitted, leaving the access opening 105 in its absence.

Rotation of at least one of the tensioning core plugs 90 relative to the other core plug 90 causes twisting of the biasing member 100 and corresponding rotational loading of the tensioning assembly 80. The twisting can cause a compressive force to be increased or decreased between the axial sides 34. By the tensioning assembly 80 applying a compressive force between the opposite sides 34 of the housing 22 at the location of the support 38, the tensioning assembly 80 is likewise configured to apply a compressive force between opposite axial end faces 108 of the supply 24, which is disposed about the support 38.

The compressive force may cause the inner portion 36 to float, generally moving along the axis 33. The inner portion 36 and/or the opposite axial side 34 may be compressed. As a result, the increasing or decreasing compressive force respectively increases or decreases the rotational resistance applied to the supply 24 to control the force necessary to dispense the sheet material 26 from the supply 24. The controlled rotational resistance correspondingly aids in controlling and creating tension of the sheet material 26 between the supply 24 and the manual pulling force of the user and/or the guiding means 27 to cause expansion of the expandable sheet material 26 therebetween.

Accordingly, in use, the unexpanded slit sheet material 26 is fed from the expandable material supply 24 in a downstream feed direction 50 toward the outlet opening 35 in the housing 22 and against the guide member 67. A pulling force manually applied by the operator cooperates with the tensioning assembly 80 and the guide member 67 to cause tension in the unexpanded (and expandable) material 26. The sheet material 26 is caused to be stretched and to expand in length and in thickness, while decreasing in width.

In the illustrated embodiment, the housing 22, the support means 23, the cover 40, the support 64, the guide member 67, the expandable sheet supply 24, and the separator sheet supply 62 are all made of a paper-based product. Thus, the majority of the illustrated apparatus 20 is recyclable, otherwise disposable after use, and composed of a renewable resource. The tensioning assembly 80 can be reused or repurposed.

In summary, the present disclosure provides a manually-operated dunnage conversion apparatus 20 that includes a housing 22, a support 36 mounted in the housing 22 and configured to support a supply 24 of sheet material 26 for dispensing from the dunnage conversion apparatus 20, and one or both of (a) a guide member 67 mounted in the housing 22 downstream of the support 36 and providing a resilient surface across which the sheet material 26 may be drawn to restrict tearing of the sheet material 26 as it is drawn from the dunnage conversion apparatus 20, and (b) a tensioning assembly 80 mounted in the housing 22 and configured to apply a compressive force between opposite axial sides 34 of the housing 22 to control the force necessary to dispense the supply of sheet material 26. Except for the tensioning assembly 80, the apparatus 20 may be made of paper-based products, making the apparatus 20 recyclable, reusable, and composed of a renewable resource, as well as inexpensive to manufacture.

The present disclosure also includes a method of manually dispensing an expanded slit sheet material 28 using the dunnage conversion apparatus 20 in combination with the supply 24 of expandable sheet material 26. The method uses the dunnage conversion apparatus 20 having a housing 22, a support 36 mounted in the housing 22 and configured to support the supply 24 for dispensing from the dunnage conversion apparatus 20, and the tensioning assembly 80 mounted in the housing 22 and configured to apply a compressive force between the opposite axial sides 34 of the housing 22 to control the force necessary to dispense the supply 24.

The method includes the steps of (a) pulling the sheet material 26 at a location adjacent an output 35 of the apparatus 20 in a direction outwardly from the apparatus 20, (b) adjusting the compressive force of the tensioning assembly 80, and (c) expanding the expandable sheet material 26 via tension between the pulling force at the output 35 and the compressive force applied to opposite axial end faces 108 of the supply 24 by the tensioning assembly 80.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A dunnage conversion apparatus, comprising:

a housing;

a support mounted in the housing and configured to support a supply of sheet material for dispensing from the dunnage conversion apparatus; and a tensioning assembly mounted in the housing and configured to apply a compressive force between opposite axial sides of the housing to control a force necessary to overcome the compressive force to dispense the sheet material from the supply;

wherein the opposite axial sides of the housing are each coupled between an opposite end of the tensioning assembly and the support; and wherein at least a portion of one of the axial sides captured between the tensioning assembly and the support is configured to float relative to the remainder of the housing.

2. The dunnage conversion apparatus of claim 1, in combination with the supply of sheet material where the supply of sheet material includes a roll of sheet material, and the tensioning assembly is configured to apply a compressive force between opposite axial end faces of the supply.

3. The dunnage conversion apparatus of claim 1, where the tensioning assembly is configured to compress an axial side of the housing between the tensioning assembly and the support.

4. The dunnage conversion apparatus of claim 1, where an axial end face of the housing includes an access opening permitting access to an axial side of the tensioning assembly.

5. The dunnage conversion apparatus of claim 1, further including a tool for engaging an axial end of the tensioning assembly for gripping the tensioning assembly during adjustment of a tension of the tensioning assembly.

6. The dunnage conversion apparatus of claim 2, where the supply of sheet stock material includes a sheet stock material having a plurality of slits arranged in a plurality of longitudinally-spaced rows that extend in a direction transverse the feed direction.

7. The dunnage conversion apparatus of claim 1, further in combination with a supply of separator sheet material supported in the housing.

8. A method of manually dispensing an expanded slit sheet material using the dunnage conversion apparatus of claim 1, the method comprising the steps of:

pulling the sheet material at a location adjacent an output of the apparatus in a direction outwardly from the apparatus, adjusting the compressive force of the tensioning assembly, and expanding the expandable sheet material via tension between the pulling force at the output and the compressive force applied to opposite axial end faces of the supply by the tensioning assembly.

* * * * *